United States Patent [19]

Takenoya et al.

[11] Patent Number: 4,611,940

[45] Date of Patent: Sep. 16, 1986

[54] PRINTER OF THE DOT IMPACT TYPE

[75] Inventors: Hideaki Takenoya; Fumiyuki Mishima, both of Tokyo, Japan

[73] Assignee: Janome Sewing Machine Co., Ltd., Tokyo, Japan

[21] Appl. No.: 618,211

[22] Filed: Jun. 7, 1984

[30] Foreign Application Priority Data

Jun. 17, 1983 [JP] Japan ..... 58-92115[U]

[51] Int. Cl.[4] ..... B41J 11/057

[52] U.S. Cl. ..... 400/649; 400/662; 400/470

[58] Field of Search ..... 400/185, 320, 320.1, 400/470, 471, 471.1, 648, 649, 662; 346/46

[56] References Cited

U.S. PATENT DOCUMENTS 4,050,569 9/1977 Crump et al. ..... 400/320
4,273,457 6/1981 Noda ..... 400/320

FOREIGN PATENT DOCUMENTS 55-142683 11/1980 Japan ..... 400/185
56-33972 4/1981 Japan ..... 400/662
57-205184 12/1982 Japan ..... 400/320
58-94488 6/1983 Japan ..... 400/649

OTHER PUBLICATIONS

*IBM Tech. Disc. Bull.;* "Color Wheel Impact Printer"; J. M. Dunn; vol. 22, No. 10, pp. 4364–4365; Mar. 1980.

*Primary Examiner*—Edgar S. Burr
*Assistant Examiner*—David A. Wiecking
*Attorney, Agent, or Firm*—Michael J. Striker

[57] ABSTRACT

A printer of the dot impact type which prints by guiding a printing paper between a printing head and a platen which is composed of a plurality of sintered bodies containing inks of different colors, and attaching the ink containing body to the printing paper, comprising a platen which changes the ink color by rotating the ink containing sintered bodies; a drive device including a one directional clutch which sends the printing paper in a normal direction by clockwise rotation of a motor, and changes the colors by counterclockwise rotation; and a switching mechanism which connects the one directional clutch to bi-directions when the printing head is moved outside on available printing scope.

4 Claims, 4 Drawing Figures

PRINTER OF THE DOT IMPACT TYPE

FIELD OF THE INVENTION

The invention relates to a printer of the dot impact type which is to be controlled by a single motor.

BACKGROUND OF THE INVENTION

The printer guides a printing paper sheet between a printing head and a platen which comprises a plurality of sintered bodies containing inks of different colors respectively, and rotates the platen to change the color ink by means of a motor or solenoid.

The printer in general employs two motors for feeding a head and feeding a paper sheet. If a motor for changing the colors were added, the machine would be made large in size, and respective controls would not be centralized.

SUMMARY OF THE INVENTION

The present invention is to change the color inks and control to feed the printing paper through a single motor by means of a drive device including a one directional clutch and a switching mechanism which connects the one directional clutch to bi-directions when the printing head is moved outside of the available scope.

DETAILED DESCRIPTION OF THE PREFERRED EMBODIMENTS

Figure 1:
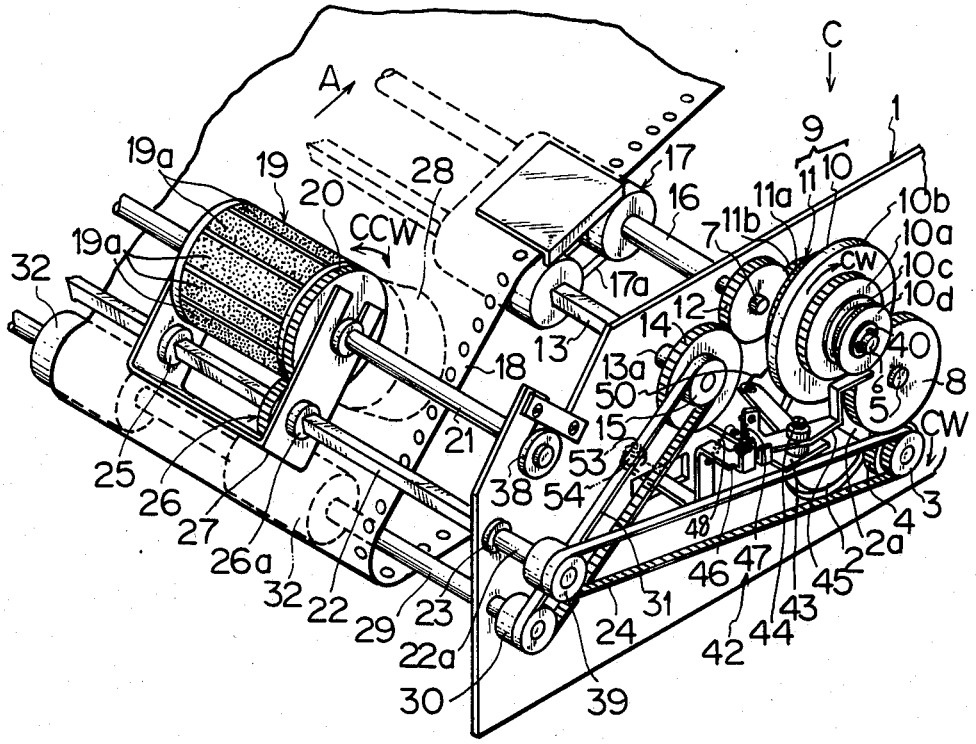
FIG. 1 is a perspective view of elemental parts of the printer.

In the following explanation, rotating directions of members are shown from a right side of FIG. 1, and lateral directions are shown in reference to standard of FIG. 1. In FIG. 1, a machine frame 1 is furnished with a motor 2, and a motor shaft 2*a* is secured with a gear 4 integral with a pulley 3. The frame 1 is implanted with pins 5, 6 and 7, and the pin 5 is rotatably supported with a gear 8 engaging with a gear 4, and the pin 6 is provided with a one directional clutch 9. The one directional clutch 9 is composed of a 1st rotary body 10 comprising a gear part 10*a*, a rotary body 10*b* and a switching transmission part 10*d* formed with a ring groove 10*c*, and a 2nd rotary body 11 comprising a pawl wheel 11*a* and a gear part 11*b*. The gear part 10*a* meshes with the gear 8, and the pawl wheel 11*a* engages with a gear 12 rotatably pivoted on pin 7.

A square shaft 13 is rotatably supported in the frame 1 by a round portion 13*a* formed therein, and is fixed at an end portion with a pulley 15 integral with a gear 14 which meshes with the gear 12.

A couple of paper feed tractors 17 (the right one is shown) are disposed to laterally move and position with respect to the square shaft 13 and a guide shaft 16 attached to the frame 1. Rotation of the shaft 13 is transmitted to a belt 17*a* which is implanted with pins on its outer circumference for feeding a printing paper sheet 18.

A platen 19 is disposed with a plurality of sintered bodies 19*a* containing inks of different colors, and is furnished with a gear 20 at an end part. Further the platen 19 is rotatable and slidable on a platen shaft 21 which is attached to the frame 1 via a bearing 38.

A square shaft 22 is rotatably supported in the frame 1 by a round portion 22*a* via a bearing 23, and is fixed at one end portion with a pulley 39 which is connected with the pulley 3 via a belt 24.

A supporter 27 of the platen is slidably provided on the square shaft 22 via a bearing 25 and a boss 26*a* of a gear 26 meshing with the gear 20, and laterally moves together with the platen 19, and when the shaft 22 is rotated, the platen 19 is rotated via the gear 26 and the gear 20.

Printing is carried out on a surface of the printing paper in when the platen 19 is slided from the left to the right in FIG. 1, while a printing head 28 is moved in the same direction. A control mechanism for laterally moving the sintered bodies 19*a* is not specifically illustrated, but in the present embodiment, the moving speed of the platen 19 is delayed in relation to the speed of the printing head 28, whereby the impact position of the printing head 28 to the platen 19 is relatively moved to the right.

That is, when the printing head 28 is positioned ready for printing at a leftmost end of the available printing range, the leftmost end of the available range of the ink containing sintered body 19*a* faces toward a pointed end of the printing head 28. When the printing head 28 is positioned at a rightmost end of the available printing range, the rightmost end of the ink containing sintered body 19*a* faces toward the pointed end of the printing head 28.

Figure 2:
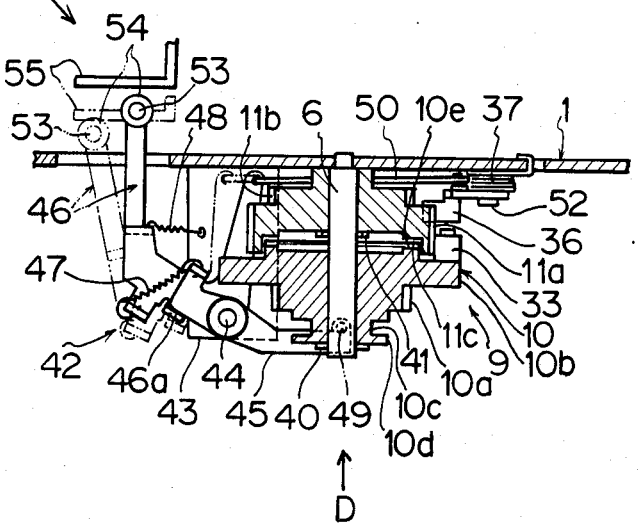
FIG. 2 is a cross sectional view seen from an arrow C in FIG. 1.

One directional clutch 9 will be described in detail. The one directional clutch 9 is composed of the 1st rotary body 10 and the 2nd rotary body 11. The 1st rotary body 10 has a pawl 33, a spring 34 and a pin 35, and is composed of the rotary body 10*b* formed with a ring shaped gear 10*e*, and a gear 10*a* formed in the rotary body 10*b*. The 1st rotary body 10 is slidable and rotatable on the pin 6, and is always biased in an axial direction as later mentioned and is contacted to a stopper ring 40 (FIG. 2) at an end. The 2nd rotary body 11 is composed of a pawl wheel 11*a* and a gear part 11*b* formed integrally with the paw wheel 11*a*. As shown in FIG. 2, a ring shaped gear 11*c* is formed in facing the gear 10*e*, and the 2nd rotary body 11 is thrust-stopped by a ring 41 (FIG. 2) and rotatable on the pin 6.

Figure 3:
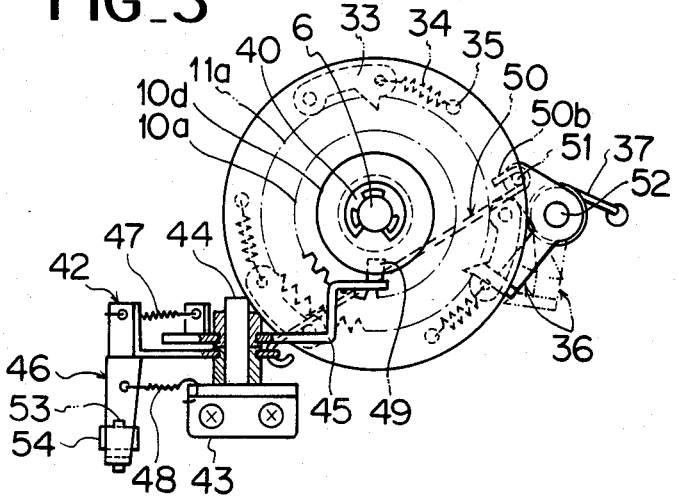
FIG. 3 is a cross sectional view seen from an arrow D in FIG. 2.

A stopper 36, having a pointed end 36*a*, is rotatably supported on a pin 52 (FIG. 2) implanted to the frame 1, and is biased by a spring 37 and engages at its pointed end 36*a* with a gear part 11*b* on the outer circumference of the pawl wheel 11*a*. As seen in FIG. 3, a pawl 33 is biased by a spring 34 toward engagement with a pawl gear of the pawl wheel 11*a*. If the 1st rotary body 10 is rotated in the clockwise direction (called as "CW" rotation) the 2nd rotary body 11 is rotated via the pawl 33 and the pawl gear and then the stopper 36 is released.

If the 1st rotary body 10 is rotated in the counterclockwise direction (called as "CCW" rotation), the pawl wheel 11*a* is stopped by the stopper 36, and the pawl 33 is released from the pawl wheel 11*a*, and the 1st rotary body 10 is idle in rotation while the 2nd rotary body 11 is not rotated.

Thus, if the 1st rotary body 10 is effected with CW rotation (therefore, the motor shaft 2*a* is rotated in CW), the 2nd rotary body 11 is rotated, but if the 1st rotary body 10 is effected with CCW rotation, the 2nd rotary body 11 is not rotated due to the action of the one directional clutch.

In the one directional clutch 9, when the stopper 36 is released by controlling a later mentioned switching mechanism 42, the ring shaped gear part 10*e* of the 1st rotary body 10 and the ring shaped gear 11*c* (FIG. 2) of the 2nd rotary body 11 are engaged, and bi-directional rotations of CW and CCW rotations of the 1st rotary body 10 are transmitted to the 2nd rotary body 11.

Figure 4:
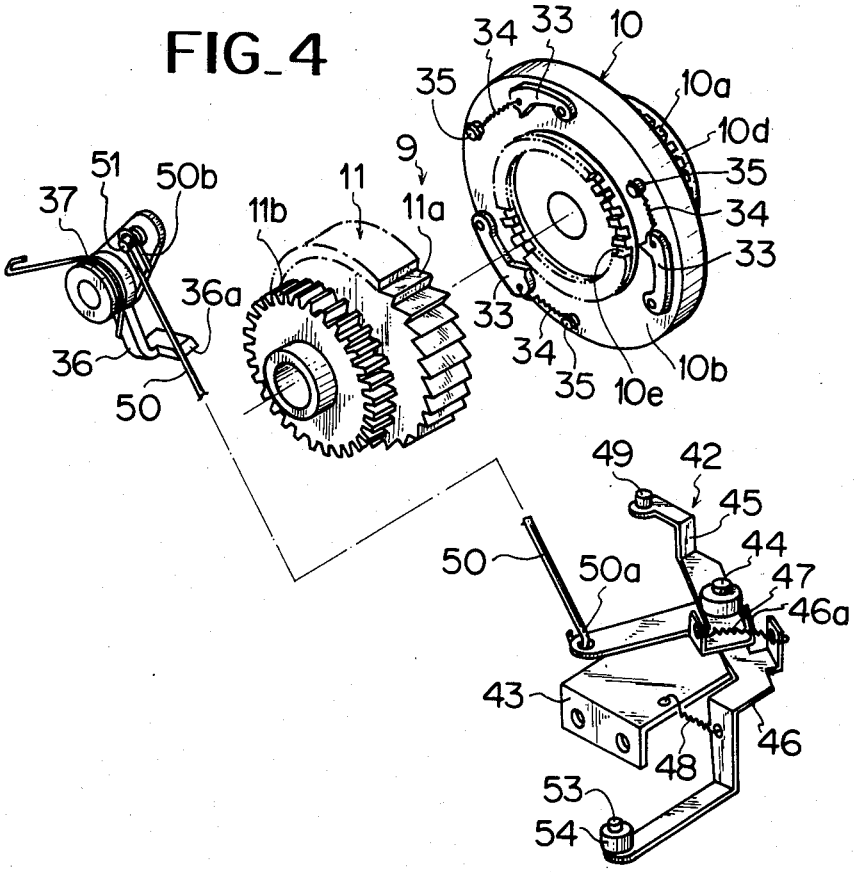
FIG. 4 is disassembled perspective view of a clutch body and a switching mechanism.

A following description will be made regarding switching mechanism 42 with reference to FIGS. 2 to 4.

The frame 1 is furnished with an attaching plate 43, and a pin 44 implanted on the plate 43 is rotatably mounted with lever 45 having a pointed end and lever 46. The lever 45 is biased by a spring 47 expanded between the levers 45 and 46 and contacts an engaging portion 46*a* of the lever 46 which is pulled by a spring 48 expanded between the lever 46 and the plate 43. A pin 49 at the pointed end of the lever 45 is fitted in the ring groove 10*c* of the 1st rotary body 10 which is biased by the spring 48 via the lever 46, part 46*a*, lever 45 and groove 10*c* and contacts the stopper ring 40. Under this condition, the gear 10*e* and the gear 11*c* are disengaged a small distance.

A rod 50 contacts the lever 46 at one end 50*a*, while it catches a pin 51 of the stopper 36 at another end 50*b*. This end 50*b* is shaped as seen in FIG. 3, and the stopper 36 is rotated CCW around the pin 52. On a pin 53 at a pointed end of the lever 46, a roller 54 is rotatably mounted.

A pressure plate 55 is secured on a carriage (not shown) attaching the printing head 28, and this plate 55 does not act on a roller 54 when the carriage is controlled within a normal printing range. In this case, the lever 46 is pulled by the spring 48 so that the 1st rotary body 10 is contacted to the stopper ring 40 via the lever 45. Since the ring shaped gear 10*e* is not engaged with the gear 11*c*, and the stopper 36 is engaged with the gear 11*b* on the outer circumference of the pawl wheel 11*a*, the clutch 9 makes one directional clutching action to transmit only CW rotation of the 1st rotary body 10 to the 2nd rotary body.

When the carriage exceeds the normal printing range, and the pressure plate 55 is moved to a position shown with a two-dotted line in FIG. 2, the lever 46 is rotated around the pin 44 against the spring 48 to the condition indicated by the two-dotted lines. The lever 45 is also moved CCW around the pin 44 via the spring 47, so that the 1st rotary body 10 is moved via the ring shaped pin 49, and the gear 10*e* is engaged with the ring shaped gear 11*c*. At the same time, the stopper 36 is rotated around the pin 52 by rotation of the lever 46 against a twist coil spring 37 to the position shown with a two-dotted line in FIG. 3, and the pointed end 36*a* of the stopper 36 is released from the gear part 11*b* and the CW and CCW rotations of the 1st rotary body 10 are transmitted to the 2nd rotary body 11. When the carriage is returned to the original position as shown in FIG. 2, the clutch 9 makes one directional clutching action.

The following explanation will be made regarding the actuation of the embodiment according to the invention. Initially described is the paper feed control such as when starting a new line of a sentence.

The paper is sent in the normal direction by CW rotation of the motor shaft 2*a* under a condition that the carriage of the printing head 28 is positioned within the printing range, and the clutch 9 serves as a one directional clutch for transmitting CW rotation. That is, referring to FIG. 1, when the motor shaft 2*a* is effected with CW rotation, the 1st rotary body 10 is rotated CW via the gears 4 and 8 and and gear part 10*a*, and the 2nd rotary body 11 is rotated CW so that the square shaft 13 is rotated CW via the gears 12 and 14, and the gear part 11*b*, and the printing paper sheet is sent in a direction indicated by an arrow A in FIG. 1 via the belt 17*a* of the tractor 17. At the same time, a roller 32 is rotated CW by the pulley 15 via a belt 31, a pulley 30 and a roller shaft 29, and the printing paper sheet 18 is sent together with a pinch roller (not shown) at the speed corresponding to the sending speed of the tractor 17.

By CW rotation of the motor shaft 2*a*, the platen 19 is concurrently rotated CCW via the pulley 3, belt 24, pulley 39, shaft 22, gear 26 and gear 20. Since the side of the platen 19 facing the paper rotates in the same direction as the paper, the platen is returned in opposition after feeding of the paper. This movement by rotation is not directly relative to the subject of the invention, and an explanation in detail will be omitted.

Changing of the color of the ink will be described next. This control is performed by CCW rotation of the motor shaft 2*a* under the same condition as said paper sending in the normal direction. In FIG. 1, the motor shaft 2*a* is rotated CCW, the platen 19 is rotated CW via the pulley 3, belt 24, pulley 39, shaft 22, gear 26, and gear 20, and the desired color is selected and the printing is made by the head 28.

In this case, the 1st rotary body 10 is rotated CCW via the gears 4 and, 8 and gears part 10*a*, but the 2nd rotary body 11 is not given rotation and the printing paper 18 is not fed.

Reverse sending of the paper is is next described. This control is performed by CCW rotation of the motor shaft 2*a* under a condition that the carriage is moved beyond the printing range to bring the lever 46 to the condition shown with the two-dotted line in FIG. 2, and the clutch body is connected to bi-directions. In FIG. 1, the motor shaft 2*a* is rotated in CCW and then the 1st rotary body 10 is rotated in CCW via the gears 4 and 8 and gear part 10. Since the clutch body 9 is connected to the bi-directions as said above, the 2nd rotary body 11 is rotated CCW so that the square shaft 13 is rotated CCW via the gears 12 and 14, and the gear part 11*b*, and further the printing paper 18 is sent in a direction opposite to the arrow A via the belt 17*a* of the tractor 17. At the same time, the roller 32 is rotated CCW by the pulley 15 via the belt 31, pulley 30, and roller shaft 29, and moves the paper with the pinch roller (not shown) at the speed corresponding to the sending speed of the tractor 17.

By CCW rotation of the motor shaft 2*a*, the platen 19 is concurrently rotated CW via the pulley 3, belt 24, pulley 39, shaft 22, gear 26 and the gear 20. Since the side of the platen 19 facing the paper rotates in to the same direction as the paper, the platen is returned in opposition within the printing range after feeding of the paper, and the motor shaft 2*a* is rotated CCW to return the platen 19 to the original condition. In this case, the paper having been fed reversely is not sent.

As having mentioned above, the present invention is to change the color inks and control to feed the printing paper through a single motor by means of a drive device including a one directional clutch and a switching mechanism which connects the one directional clutch to bi-directions, thereby enabling the printing paper to be sent normally and reversely, so that the controls may be centralized and the machine size may be reduced.

While the invention has been illustrated and described as embodied in a dot impact printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A printer of a dot impact type, comprising a printing head, a platen arranged so that a printing paper is guided between the printing head and the platen, the platen having an outer circumference and on the latter a plurality of sintered bodies containing different colors of ink and engagable with the printing paper, said platen and said printing head being movable in a letter space direction within at least a printing region, said platen being rotatable so as to change the color ink by changing the position of the ink containing sintered bodies; a drive device including a motor rotatable in clockwise and counterclockwise directions, feed means for feeding said paper in a linespace direction, a one-directional clutch arranged to transmit rotation of said motor to the feed means in said line space direction during rotation of the motor in a clockwise direction and to change the color by rotation of said platen during rotation of the motor in a counterclockwise direction; and means responsive to movement of said printing head beyond said printing region to switch the one directional clutch to transmit rotation of said motor to said feed means in both directions.

2. The printer as defined in claim 1, wherein said one-directional clutch includes a first rotary body operatively connected to said motor and carrying a first gear thereon and a second rotary body carrying a second gear thereon engageable with said first gear, and rotatable stopper means connectable with said second rotary body so that if said first rotary body is rotated in clockwise direction said stopper is released and said second rotary body is rotated but if said first rotary body is rotated in counterclockwise direction said second rotary body is not rotated.

3. The printer as defined in claim 2, wherein said means to switch the one-directional clutch includes a movable pressure plate connected to said printing head, a lever mechanism including a first rotatable lever carrying a pin engaged in a groove of said first rotary body, a second rotatable lever connected to said first lever and carrying a rod connected to said stopper means to rotate the latter and provided with a roller cooperating with said pressure plate.

4. The printer as defined in claim 3, further including transmission means connected to said drive device and including first pulley-belt means connected to said motor, first gear means connected to said platen to transmit rotation of said motor to said platen, second pulley-belt means connected to said second rotary body of said clutch, and a roller shaft connected to said second pulley-belt means to be rotated thereby and to move the paper toward said feed means.

* * * * *